US009404388B2

(12) United States Patent
Feng et al.

(10) Patent No.: US 9,404,388 B2
(45) Date of Patent: Aug. 2, 2016

(54) ARTICLE AND METHOD FOR FORMING AN ARTICLE

(71) Applicant: GENERAL ELECTRIC COMPANY, Schenectady, NY (US)

(72) Inventors: Ganjiang Feng, Greenville, SC (US); Mark R. Brown, Greenville, SC (US); Michael Douglas Arnett, Simpsonville, SC (US); Matthew J. Laylock, Mauldin, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 349 days.

(21) Appl. No.: 14/193,576

(22) Filed: Feb. 28, 2014

(65) Prior Publication Data

US 2015/0247422 A1 Sep. 3, 2015

(51) Int. Cl.

| | |
|---|---|
| ***C22C 19/05*** | (2006.01) |
| ***B22D 21/00*** | (2006.01) |
| ***F01D 25/00*** | (2006.01) |
| ***C22F 1/10*** | (2006.01) |
| ***B22D 27/04*** | (2006.01) |
| ***B22D 7/00*** | (2006.01) |
| ***F01D 5/28*** | (2006.01) |
| *C22C 19/00* | (2006.01) |

(52) U.S. Cl.

CPC ..... *F01D 25/005* (2013.01); *B22D 7/005* (2013.01); *B22D 21/005* (2013.01); *B22D 27/045* (2013.01); *C22C 19/056* (2013.01); *C22F 1/10* (2013.01); *F01D 5/28* (2013.01)

(58) Field of Classification Search

CPC ..... C22C 19/03; C22C 19/05; C22C 19/051; C22C 19/056; C22F 1/10; B22D 21/005; B22D 27/045; F01D 5/28; F01D 25/005

USPC ..... 148/426–429, 675–677; 420/441, 420/445–451, 457, 460

See application file for complete search history.

(56) References Cited

U.S. PATENT DOCUMENTS

| | | | | |
|---|---|---|---|---|
| 3,615,376 | A | 10/1971 | Ross | |
| 6,416,596 | B1 | 7/2002 | Wood et al. | |
| 7,153,377 | B2 * | 12/2006 | Spangler, Jr. | B03C 1/015 148/674 |
| 2003/0111138 | A1 | 6/2003 | Cetel | |
| 2004/0177901 | A1 | 9/2004 | Yoshinari et al. | |
| 2009/0041615 | A1 | 2/2009 | James et al. | |
| 2013/0177442 | A1 | 7/2013 | Walker et al. | |

FOREIGN PATENT DOCUMENTS

| | | | |
|---|---|---|---|
| EP | 2520678 | A2 | 11/2012 |

OTHER PUBLICATIONS

European Search Report and Opinion issued in connection with corresponding EP Application No. 15156134.7 on Jul. 16, 2015.

* cited by examiner

*Primary Examiner* — Lois Zheng

(57) ABSTRACT

An article and a method for forming the article are disclosed. The article comprising a composition, wherein the composition comprises, by weight percent, about 13.7% to about 14.3% chromium (Cr), about 9.0% to about 10.0% cobalt (Co), about 3.5% to about 3.9% aluminum (Al), about 3.4% to about 3.8% titanium (Ti), about 4.0% to about 4.4% tungsten (W), about 1.4% to about 1.7% molybdenum (Mo), about 1.55% to about 1.75% niobium (Nb), about 0.08% to about 0.12% carbon (C), about 0.005% to about 0.040% zirconium (Zr), about 0.010% to about 0.014% boron (B), and balance nickel (Ni) and incidental impurities. The composition is substantially free of tantalum (Ta) and includes a microstructure substantially devoid of Eta phase.

20 Claims, 3 Drawing Sheets

ARTICLE AND METHOD FOR FORMING AN ARTICLE

FIELD OF THE INVENTION

The present invention is directed to a nickel-based superalloy, an article formed of a nickel-based superalloy and a method for forming an article.

BACKGROUND OF THE INVENTION

Hot gas path components of gas turbines and aviation engines, particularly turbine blades, vanes, nozzles, seals and stationary shrouds, operate at elevated temperatures, often in excess of 2,000° F. The superalloy compositions used to form hot gas path components are often single-crystal compositions incorporating significant amounts of tantalum (Ta).

The present invention is an improvement to the class of alloys disclosed and claimed in U.S. Pat. No. 6,416,596 B1, issued Jul. 9, 2002 to John H. Wood et al.; which was an improvement to the class of alloys disclosed and claimed in U.S. Pat. No. 3,615,376, issued Oct. 26, 1971 to Earl W. Ross. Both patents are assigned to the assignee hereof and are incorporated by reference in their entirety. One known superalloy composition within the above class of alloys is referred to herein as "GTD-111." GTD-111 has a nominal composition, in weight percent of the alloy, of 14% chromium, 9.5% cobalt, 3.8% tungsten, 1.5% molybdenum, 4.9% titanium, 3.0% aluminum, 0.1% carbon, 0.01% boron, 2.8% tantalum, and the balance nickel and incidental impurities. GTD-111 is a registered trademark of General Electric Company.

GTD-111 contains substantial concentrations of titanium (Ti) and tantalum (Ta). In certain conditions, Eta phase may form on the mold surfaces and in the interior of the casting, which, in some cases results in the formation of cracks. An attribute of the alloys disclosed and claimed in U.S. Pat. No. 6,416,596, including GTD-111, is the presence of "Eta" phase, a hexagonal close-packed form of the intermetallic $Ni_3Ti$, as well as segregated titanium metal in the solidified alloy. During alloy solidification, titanium has a strong tendency to be rejected from the liquid side of the solid/liquid interface, resulting in the segregation (local enrichment) of titanium in the solidification front and promoting the formation of Eta in the last solidified liquid. The segregation of titanium also reduces the solidus temperature, increasing the fraction of gamma/gamma prime ($\gamma/\gamma'$) eutectic phases and resulting micro-shrinkages in the solidified alloy. The Eta phase, in particular, may cause certain articles cast from those alloys to be rejected during the initial casting process, as well as post-casting, machining and repair processes. In addition, the presence of Eta phase may result in degradation of the alloy's mechanical properties during service exposure.

In addition to the formation of Eta, the class of alloys claimed in U.S. Pat. No. 6,416,596 is susceptible to the formation of detrimental topologically close-packed (TCP) phases (e.g., $\mu$ and $\sigma$ phases). TCP phases form after exposure at temperatures above about 1500° F. TCP phases are not only brittle, but their formation reduces solution strengthening potential of the alloy by removing solute elements from the desired alloy phases and concentrating them in the brittle phases so that intended strength and life goals are not met. The formation of TCP phases beyond small nominal amounts results from the composition and thermal history of the alloy.

Articles and methods having improvements in the process and/or the properties of the components formed would be desirable in the art.

BRIEF DESCRIPTION OF THE INVENTION

In one embodiment, an article comprising a composition, wherein the composition comprises, by weight percent, about 13.7% to about 14.3% chromium (Cr), about 9.0% to about 10.0% cobalt (Co), about 3.5% to about 3.9% aluminum (Al), about 3.4% to about 3.8% titanium (Ti), about 4.0% to about 4.4% tungsten (W), about 1.4% to about 1.7% molybdenum (Mo), about 1.55% to about 1.75% niobium (Nb), about 0.08% to about 0.12% carbon (C), about 0.005% to about 0.040% zirconium (Zr), about 0.010% to about 0.014% boron (B), and balance nickel (Ni) and incidental impurities. The composition is substantially free of tantalum (Ta) and includes a microstructure substantially devoid of Eta phase and TCP phases In another embodiment, a method for forming an article includes providing a composition and forming the article. The method includes casting a composition, by weight percent, of about 13.7% to about 14.3% chromium (Cr), about 9.0% to about 10.0% cobalt (Co), about 3.5% to about 3.9% aluminum (Al), about 3.4% to about 3.8% titanium (Ti), about 4.0% to about 4.4% tungsten (W), about 1.4% to about 1.7% molybdenum (Mo), about 1.55% to about 1.75% niobium (Nb), about 0.08% to about 0.12% carbon (C), about 0.005% to about 0.040% zirconium (Zr), about 0.010% to about 0.014% boron (B), and balance nickel (Ni) and incidental impurities. The composition is substantially free of tantalum (Ta). The method includes heat treating the composition to form a heat-treated microstructure. The heat-treated microstructure is substantially devoid of Eta phase and TCP phases.

Other features and advantages of the present invention will be apparent from the following more detailed description, taken in conjunction with the accompanying drawings which illustrate, by way of example, the principles of the invention.

DETAILED DESCRIPTION OF THE INVENTION

Figure 1:
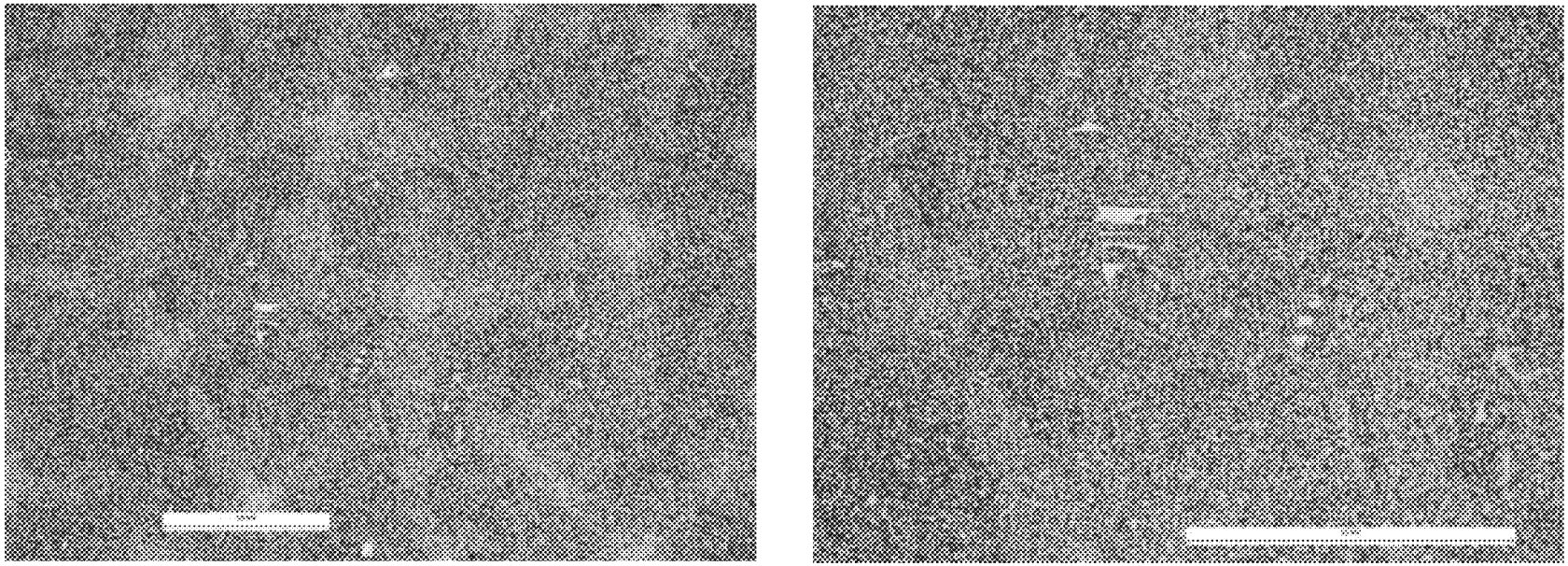
FIG. 1 shows micrographs of a cast composition, according to the present disclosure.

Provided are an article and a method for forming an article. Embodiments of the present disclosure, in comparison to methods and articles not using one or more of the features disclosed herein, increase corrosion resistance, increase oxidation resistance, lengthen low-cycle fatigue lifetime, lengthen high-cycle fatigue lifetime, increase creep lifetime, improved castability, increase phase stability at elevated temperatures, decrease cost, or a combination thereof. Embodiments of the present disclosure enable the fabrication of hot gas path components of gas turbines and gas turbine engines with tantalum-free nicked-based superalloys having at least as advantageous properties at elevated temperatures as tantalum-containing nicked-based superalloys and being free of Eta phase and TCP phases.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

In one embodiment, an article includes a composition comprising, by weight percent, about 13.7% to about 14.3% chromium (Cr), about 9.0% to about 10.0% cobalt (Co), about 3.5% to about 3.9% aluminum (Al), about 3.4% to about 3.8% titanium (Ti), about 4.0% to about 4.4% tungsten (W), about 1.4% to about 1.7% molybdenum (Mo), about 1.55% to about 1.75% niobium (Nb), about 0.08% to about 0.12% carbon (C), about 0.005% to about 0.040% zirconium (Zr), about 0.010% to about 0.014% boron (B), and balance nickel (Ni) and incidental impurities. The composition is devoid of tantalum (Ta) or includes tantalum (Ta) as a trace element. In a further embodiment, tantalum (Ta) is present in an amount of less than about 0.01% or less than about 0.001%, by weight, of the composition.

In one embodiment of the present invention, a ratio of aluminum to titanium in the alloy composition from 0.92 to 1.15 or from 0.95 to 1.10 or about 1.00.

In a further embodiment, the composition includes, by weight percent, about 13.9% to about 14.1% chromium (Cr), about 9.25% to about 9.75% cobalt (Co), about 3.6% to about 3.8% aluminum (Al), about 3.5% to about 3.7% titanium (Ti), about 4.1% to about 4.3% tungsten (W), about 1.5% to about 1.6% molybdenum (Mo), about 1.60% to about 1.70% niobium (Nb), about 0.09% to about 0.11% carbon (C), about 0.010% to about 0.030% zirconium (Zr), about 0.011% to about 0.013% boron (B), and balance nickel (Ni) and incidental impurities. In a further embodiment, the composition includes, by weight percent, about 14.0% chromium (Cr), about 9.50% cobalt (Co), about 3.7% aluminum (Al), about 3.6% titanium (Ti), about 4.2% tungsten (W), about 1.55% molybdenum (Mo), about 1.65% niobium (Nb), about 0.10% carbon (C), about 0.02% zirconium (Zr), about 0.012% boron (B), and balance nickel (Ni) and incidental impurities. The composition is devoid of tantalum (Ta) or includes tantalum (Ta) as a trace element.

Articles formed of the composition, according to the present disclosure, achieve mechanical properties in the superalloy that equal or exceed those of conventional superalloys, such as GTD-111, while minimizing or, ideally, completely avoiding the formation of microstructural instabilities such as Eta phase and TCP phases. For example, the nickel-base superalloy cast article of the present invention has an improved combination of corrosion resistance, oxidation resistance, lengthened low-cycle fatigue lifetime, lengthened high-cycle fatigue lifetime, increased creep lifetime, improved castability, increased phase stability at elevated temperatures, decreased cost, all with respect to GTD-111 and minimizes or eliminates detrimental formation of Eta phase and the detrimental formation of topologically close-packed phases in the superalloy microstructure at elevated temperatures. The nickel-based superalloy article is characterized by an improved combination of creep life and microstructural stability in which the detrimental formation of Eta phase and topologically close-packed phase are minimized or eliminated in the superalloy microstructure at elevated temperatures. In one embodiment, the microstructure formed from the composition, according to the present disclosure, is devoid of Eta phase. In one embodiment, the microstructure formed from the composition is devoid of TCP phases.

In one embodiment, the method for forming the article includes providing the composition and forming the article from the composition. In a further embodiment, forming the article from the composition includes any suitable technique, including, but not limited to, casting.

As mentioned above, any casting method may be utilized, e.g., ingot casting, investment casting or near net shape casting. In embodiments wherein more complex parts are desirably produced, the molten metal may desirably be cast by an investment casting process which may generally be more suitable for the production of parts that cannot be produced by normal manufacturing techniques, such as turbine buckets, that have complex shapes, or turbine components that have to withstand high temperatures. In another embodiment, the molten metal may be cast into turbine components by an ingot casting process. The casting may be done using gravity, pressure, inert gas or vacuum conditions. In some embodiments, casting is done in a vacuum.

In one embodiment, the melt in the mold is directionally solidified. Directional solidification generally results in single-crystal or columnar structure, i.e., elongated grains in the direction of growth, and thus, higher creep strength for the airfoil than an equiaxed cast, and is suitable for use in some embodiments. In a directional solidification, dendritic crystals are oriented along a directional heat flow and form either a columnar crystalline microstructure (i.e. grains which run over the entire length of the work piece and are referred to here, in accordance with the language customarily used, as directionally solidified (DS)). In this process, a transmission to globular (polycrystalline) solidification needs to be avoided, since non-directional growth inevitably forms transverse and longitudinal grain boundaries, which negate the favorable properties of the directionally solidified (DS).

The cast articles comprising the nickel-based alloy are typically subjected to different heat treatments in order to optimize the strength as well as to increase creep resistance. In some embodiments, the castings are desirably solution heat treated at a temperature between the solidus and gamma prime solvus temperatures. Solidus is a temperature at which alloy starts melting during heating, or finishes solidification during cooling from liquid phase. Gamma prime solvus is a temperature at which gamma prime phase completely dissolves into gamma matrix phase during heating, or starts precipitating in gamma matrix phase during cooling. Such heat treatments generally reduce the presence of segregation. After solution heat treatments, alloys are heat treated below gamma prime solvus temperature to form gamma prime precipitates.

Articles formed of the composition, according to the present disclosure, have fine eutectic areas compared with conventional superalloy compositions, such as GTD-111. The formed articles include longer low cycle fatigue (LCF) lifetimes due to less crack initiation sites resulting from the composition of the disclosure. In addition, the refined eutectic area also results in more gamma primes formed in the solidification process going into solution upon heat treatment.

In one embodiment, the nickel-based alloys described are processed into a hot gas component of a gas turbine or an aviation engine, and wherein the hot gas path component is subjected to temperatures of at least about 2,000° F. In a further embodiment, the hot gas path component is selected from the group consisting of a bucket or blade, a vane, a nozzle, a seal, a combustor, and a stationary shroud. In one embodiment, the nickel-based alloys are processed into turbine buckets (also referred to as turbine blades) for large gas turbine machines.

EXAMPLES

Example 1

A directionally solidified composition, according to the present disclosure, was directionally solidified and was subjected to solution heat treated at 2050° F. for 2 hours and aged at 1550° F. for 4 hours. FIG. 1 shows a micrograph of the cast composition at two different magnifications. As is shown in FIG. 1, Example 1 includes a microstructure that is 75% in solution, with a fine eutectic phase having less than 1 mil over the majority of the sample. No Eta phase and no TCP phases are present in the sample.

Example 2

Figure 2:
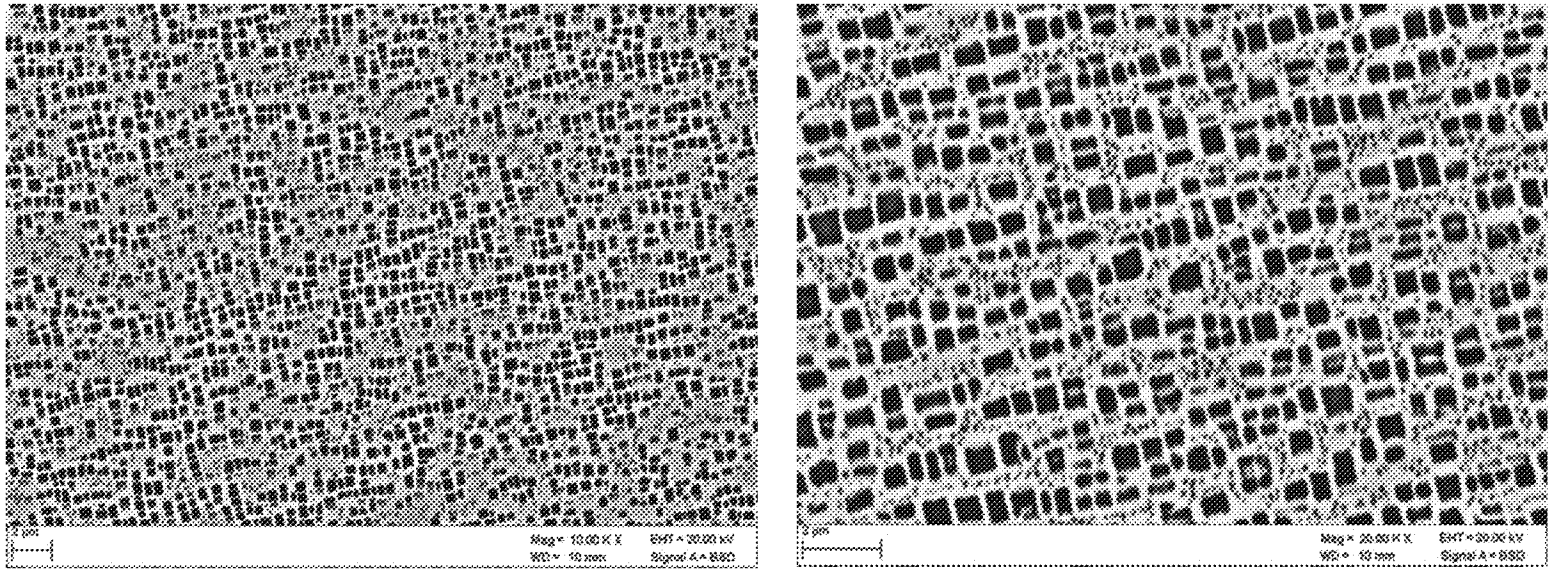
FIG. 2 shows micrographs of a cast composition subjected to creep testing, according to the present disclosure.

A directionally solidified composition, according to the present disclosure, was subjected to a creep rupture test at 1500° F. for 1201 hours. FIG. 2 shows a micrograph of the resulting microstructure of the tested sample at two different magnifications. As is shown in FIG. 2, Example 2 includes a bimodal gamma prime microstructure having no Eta phase and no TCP phases are present in the sample. In addition, gamma double prime phases are not identified in the sample.

Figure 3:
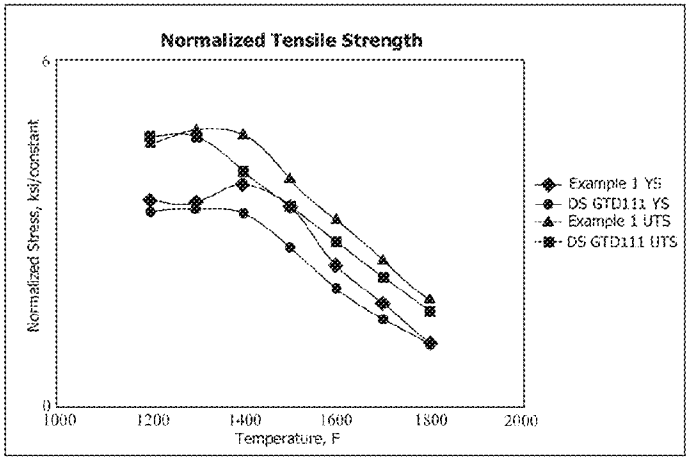
FIG. 3 shows graphs illustrating tensile strength and yield strength of an alloy, according to the present disclosure and GTD-111.
Figure 4:
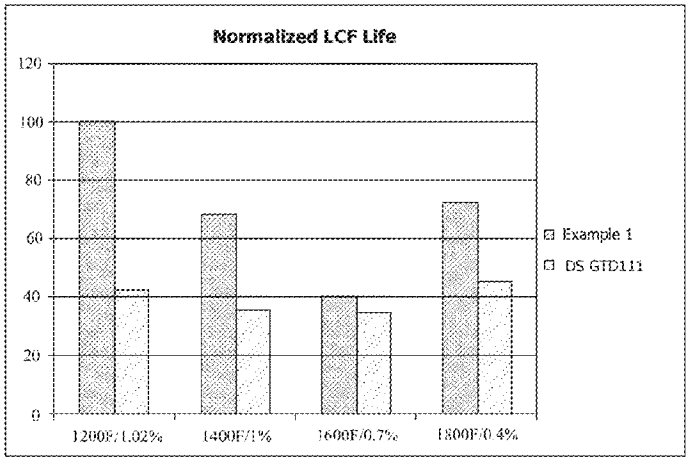
FIG. 4 shows graphs illustrating the comparative low-cycle fatigue properties of an alloy, according to the present disclosure and GTD-111.
Figure 5:
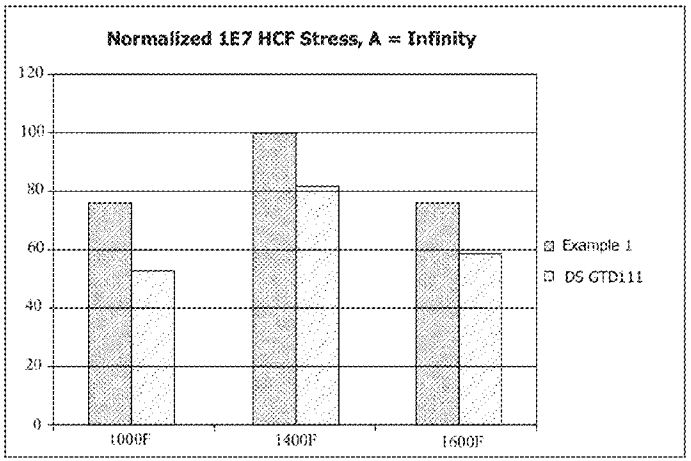
FIG. 5 shows graphs illustrating the comparative high-cycle fatigue properties of an alloy, according to the present disclosure and GTD-111.
Figure 6:
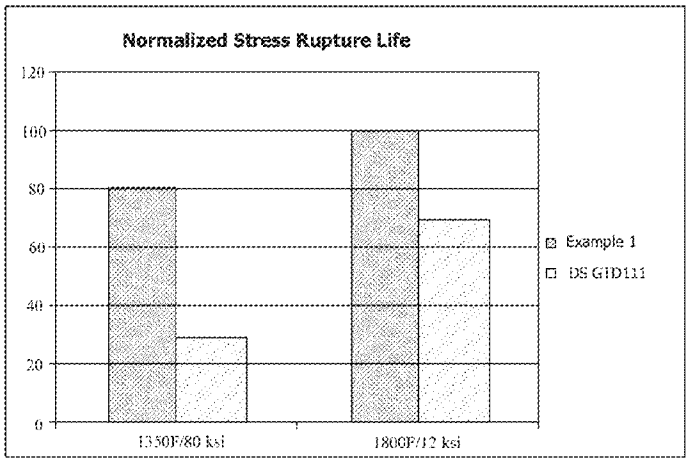
FIG. 6 shows graphs illustrating the comparative stress rupture life of an alloy, according to the present disclosure and GTD-111.

FIG. 3 shows tensile strength and yield strength for Example 1, according to the present disclosure, with respect to comparative results of GTD-111. FIG. 4 shows comparative low-cycle fatigue properties for Example 1, according to the present disclosure, with respect to comparative results of GTD-111. FIG. 5 shows comparative high-cycle fatigue properties for Example 1, according to the present disclosure, with respect to comparative results of GTD-111. FIG. 6 shows comparative stress rupture life for Example 1, according to the present disclosure, with respect to comparative results of GTD-111.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An article comprising a composition, wherein the composition comprises, by weight percent:
about 13.7% to about 14.3% chromium (Cr);
about 9.0% to about 10.0% cobalt (Co);
about 3.5% to about 3.9% aluminum (Al);
about 3.4% to about 3.8% titanium (Ti);
about 4.0% to about 4.4% tungsten (W);
about 1.4% to about 1.7% molybdenum (Mo);
about 1.55% to about 1.75% niobium (Nb);
about 0.08% to about 0.12% carbon (C);
about 0.005% to about 0.040% zirconium (Zr);
about 0.010% to about 0.014% boron (B);
balance nickel (Ni) and incidental impurities, and wherein the composition is substantially free of tantalum (Ta) and the composition includes a microstructure substantially devoid of Eta phase.

2. The article of claim 1, wherein the microstructure is devoid of Eta phase.

3. The article of claim 1, wherein the microstructure is devoid of TCP phases.

4. The article of claim 1, wherein the microstructure is devoid of Eta phase and TCP phases.

5. The article of claim 1, wherein the composition is directionally solidified.

6. The article of claim 1, wherein the composition comprises, by weight percent:
about 13.9% to about 14.1% chromium (Cr);
about 9.25% to about 9.75% cobalt (Co);
about 3.6% to about 3.8% aluminum (Al);
about 3.5% to about 3.7% titanium (Ti);
about 4.1% to about 4.3% tungsten (W);
about 1.5% to about 1.6% molybdenum (Mo);
about 1.60% to about 1.70% niobium (Nb);
about 0.09% to about 0.11% carbon (C);
about 0.010% to about 0.030% zirconium (Zr);
about 0.011% to about 0.013% boron (B);
balance nickel (Ni) and incidental impurities.

7. The article of claim 1, wherein the composition comprises, by weight percent about 14.0% chromium (Cr), about 9.50% cobalt (Co), about 3.7% aluminum (Al), about 3.6% titanium (Ti), about 4.2% tungsten (W), about 1.55% molybdenum (Mo), about 1.65% niobium (Nb), about 0.10% carbon (C), about 0.02% zirconium (Zr), about 0.012% boron (B), and balance nickel (Ni) and incidental impurities.

8. The article of claim 1, wherein the article is a hot gas path component of a gas turbine or an aviation engine, and wherein the hot gas path component is subjected to temperatures of at least about 2,000° F.

9. The article of claim 8, wherein the hot gas path component is selected from the group consisting of a blade, a vane, a nozzle, a seal and a stationary shroud.

10. A method for forming an article, comprising:
casting a composition comprising, by weight percent:
about 13.7% to about 14.3% chromium (Cr);
about 9.0% to about 10.0% cobalt (Co);
about 3.5% to about 3.9% aluminum (Al);
about 3.4% to about 3.8% titanium (Ti);
about 4.0% to about 4.4% tungsten (W);
about 1.4% to about 1.7% molybdenum (Mo);
about 1.55% to about 1.75% niobium (Nb);
about 0.08% to about 0.12% carbon (C);
about 0.005% to about 0.040% zirconium (Zr);
about 0.010% to about 0.014% boron (B);
balance nickel (Ni) and incidental impurities, the composition being substantially free of tantalum (Ta);
heat treating the composition to form a heat-treated microstructure;
wherein the heat-treated microstructure is substantially devoid of Eta phase.

11. The method of claim 10, wherein the heat-treated microstructure is devoid of Eta phase.

12. The method of claim 10, wherein the heat-treated microstructure is devoid of TCP phases.

13. The method of claim 10, wherein the heat-treated microstructure is devoid of Eta phase and TCP phases.

14. The method of claim 10, wherein the composition comprises, by weight percent:
about 13.9% to about 14.1% chromium (Cr);
about 9.25% to about 9.75% cobalt (Co);
about 3.6% to about 3.8% aluminum (Al);
about 3.5% to about 3.7% titanium (Ti);
about 4.1% to about 4.3% tungsten (W);
about 1.5% to about 1.6% molybdenum (Mo);

about 1.60% to about 1.70% niobium (Nb);
about 0.09% to about 0.11% carbon (C);
about 0.010% to about 0.030% zirconium (Zr);
about 0.011% to about 0.013% boron (B);
balance nickel (Ni) and incidental impurities.

15. The method of claim 10, wherein the composition comprises, by weight percent about 14.0% chromium (Cr), about 9.50% cobalt (Co), about 3.7% aluminum (Al), about 3.6% titanium (Ti), about 4.2% tungsten (W), about 1.55% molybdenum (Mo), about 1.65% niobium (Nb), about 0.10% carbon (C), about 0.02% zirconium (Zr), about 0.012% boron (B), and balance nickel (Ni) and incidental impurities.

16. The method of claim 10, wherein the article is a hot gas path component of a gas turbine or an aviation engine, and wherein the hot gas path component is subjected to temperatures of at least about 2,000° F.

17. The method of claim 10, wherein the hot gas path component is selected from the group consisting of a blade, a vane, a nozzle, a seal and a stationary shroud.

18. The method of claim 10, wherein casting the composition comprises one of ingot casting, investment casting and near net shape casting.

19. The method of claim 18, wherein casting the composition comprises investment casting.

20. The method of claim 10, wherein casting the composition includes directionally solidifying the composition.

* * * * *